United States Patent [19]

Yoshida

[11] 4,396,294

[45] Aug. 2, 1983

[54] CORRECTION SYSTEM FOR ELECTRONIC TIMEPIECE WITH BOTH ANALOG AND DIGITAL DISPLAYS

[75] Inventor: Masaru Yoshida, Tanashi, Japan

[73] Assignee: Citizen Watch Company Limited, Tokyo, Japan

[21] Appl. No.: 233,407

[22] Filed: Feb. 11, 1981

[30] Foreign Application Priority Data

Feb. 12, 1980 [JP] Japan ..... 55-14821

[51] Int. Cl.[3] ..... G04B 27/04

[52] U.S. Cl. ..... 368/71; 368/74; 368/191

[58] Field of Search ..... 368/71, 74, 190, 191, 368/192, 193

[56] References Cited

U.S. PATENT DOCUMENTS 4,209,976 7/1980 Flumm ..... 368/190
4,250,572 2/1981 Yoshida ..... 368/71
4,277,840 7/1981 Sekiya et al. ..... 368/71

*Primary Examiner*—J. V. Truhe
*Assistant Examiner*—Forester W. Isen
*Attorney, Agent, or Firm*—Jordan and Hamburg

[57] ABSTRACT

In an electronic timepiece equipped with both an analog display section having time indicating hands and a digital display section, a time correction system is provided whereby correction of both the analog and digital time displays can be performed by rotation of a crown, with the directions of rotation of the crown for time data incrementation and decrementation being identical both for analog and digital display correction. Selection of either analog time correction or digital time correction is performed simply by pulling the crown out to either of two axial positions. Correction of both analog and digital time display information is thereby simplified and made more rapid, while the number of external operating members is reduced.

24 Claims, 11 Drawing Figures

| Fig. 7A | Fig. 7B | Fig. 7C |
|---|---|---|

CORRECTION SYSTEM FOR ELECTRONIC TIMEPIECE WITH BOTH ANALOG AND DIGITAL DISPLAYS

BACKGROUND OF THE INVENTION

At the present time, large numbers of electronic timepieces are being produced, in which a quartz crystal vibrator is used in an oscillator circuit to form a standard frequency signal. Such timepieces could initially be categorized into the digital type, in which time data is displayed in digital form by means of an electro-optical display device such as a liquid crystal display, and those having conventional time indicating hands and a dial. The latter type of timepiece is commonly referred to as an "analog" type, although it is of course perfectly possible to provide an analog display of time data by means of a liquid crystal display device. However, for convenience of description, a timepiece time display comprising time indicating hands and a dial will be referred to herein as an analog display. In recent years, a third type of electronic timepiece has come into widespread use, in which an analog display of the type referred to above is combined with a digital display of time. Such timepieces are designed to provide the advantages of an analog display (i.e. easy discrimination of the difference between the current time and some future time, or of the time which has elapsed between some time in the past and the current time), with the advantages of high readout precision, easy provision of a large number of different function modes, display of calendar data, etc.) that are provided by a digital display. However, some difficulties arise with respect to the method of correcting the analog and digital time data displayed by such a timepiece. In a purely analog display electronic timepiece, correction can be easily, conveniently and rapidly performed by means of rotation of an external operating member, i.e. the timepiece crown, in the same way as is done with a conventional mechanical timepiece. This is possible because the timekeeping hands are driven through a gear train by a stepping motor, in such a timepiece. With such a correction system, the correction of minutes and hours is performed in a smooth and continuous manner, i.e. when a time of 59 minutes has been set and the crown is rotated further in one direction, the minutes hand will go to zero and the hours hand will indicate the next hour. If some overshoot occurs during the correction process, past the desired time, then this can easily be remedied by rotating the crown slightly in the opposite direction. With a digital display timepiece, on the other hand, it is generally necessary to depress a pushbutton switch one or more times to set the hours or minutes time data. In other words, if correction of the minutes data has been selected, then each depression of the correction switch pushbutton will result in the minutes being incremented by one. Similarly, if the hours have been selected for correction, each depression will result in an increment of one hour. Thus, when correcting the minutes data, it may be necessary to depress the correction switch up to 59 times. In this case, if the switch is depressed once too often, by mistake, then it will be necessary to repeat the depression procedure another 59 times. For this reason, it is not practicable to provide for continuous correction from the minutes data to the hours data, i.e. to provide for a carry into the hours data register when a value of 59 in the minutes data register is exceeded. It is therefore generally necessary to provide two pushbutton switches for correction of such a digital display, one of which selects the digit or digits to be corrected, and the other being a correction switch which is repetitively depressed to perform the actual correction. It will be apparent that such a correction procedure is rather inconvenient and complex, by comparison with the analog timepiece correction method using a rotatable crown.

In electronic timepieces of the prior art which have combined analog and digital displays, it has been usual to provide separate correction means for the analog and digital displays which are basically as described in the preceding paragraph, i.e. a rotatable external operating member such as a crown is used to correct the analog display, while at least two pushbutton switches are used to correct the digital display. Thus, the time correction procedure is extremely complex and inconvenient in such a timepiece.

It is therefore highly desirable that means be provided in an electronic timepiece having both analog and digital time displays, whereby both of said analog and digital displays can be corrected in a simple and rapid manner, and whereby the number of operating members provided externally to perform such correction can be minimized.

SUMMARY OF THE INVENTION

The present invention provides an improved correction system for an electronic timepiece having both analog and digital time displays, whereby the various disadvantages of prior art correction systems for such timepieces, described hereinabove, are substantially alleviated. With a correction system according to the present invention, a single rotatable external operating member (i.e. a timepiece crown) is rotated in a similar manner both when performing correction of the digital display and when correcting the analog display. In other words, if the timepiece is set in a condition for correction of the digital time display, and if incrementation of the digital time data is performed by rotation of the crown in the clockwise direction, and decrementation is performed by rotation of the crown in the counterclockwise direction, then similarly when the timepiece is set in a condition for correction of the analog time data then rotation of the crown in the clockwise direction will result in incrementation of the analog time data (i.e. advancement of the time indicating hands), while rotation of the crown in the counterclockwise direction will result in decrementation of the analog time data. In addition, with a correction system according to the present invention, correction of the minutes and hours of the digital time display data is performed in a continuous manner, i.e. when the minutes digital data has a value of 59, and if an incrementing correction signal is input by rotation of the crown, then overflow will occur into the hours time data, i.e. the digital displayed hours will be incremented by one and the digital minutes data reset to zero. In such a condition, rotation of the crown in the opposite direction will result in the hours data being decremented by one, and the minutes data successively attaining values of 59, 58, and so on. It can thus be seen that correction of the analog time data and the digital time data is performed in a very similar manner in each case, by rotation of the timepiece crown. Such time correction is very easy and convenient for the user, and represents a substantial increase in the market appeal of a timepiece incorporating such a correction system, by comparison with timepieces of the prior art which include both analog and digital time displays. A further advantage of the present invention is that with such a correction system, the number of external operating members required to perform correction of the analog and digital time displays is reduced. As will be explained with reference to the preferred embodiments, it is possible to utilize axial movement of the crown in order to select either a normal (i.e. non-correcting) mode of operation, an analog display correction mode, or a digital display correction mode. In addition, by suitably coupling a switch to the crown, it is possible to perform selection of the various digital function modes (i.e. alarm time, current time, calendar, etc), for which correction can then be performed. With a correction system according to the present invention, therefore, all of the operations necessary for correction of the analog and digital displays can be achieved by utilizing single crown and, at most, one other externally actuated switch if necessary. Thus, an electronic timepiece having a correction system according to the present invention offers the advantages of both easier and more convenient operation by the user, together with greater ease and economy of manufacture, since the number of external operating members required for correction of the analog and digital displays is reduced to the minimum possible.

DESCRIPTION OF THE PREFERRED EMBODIMENT

Figure 1:
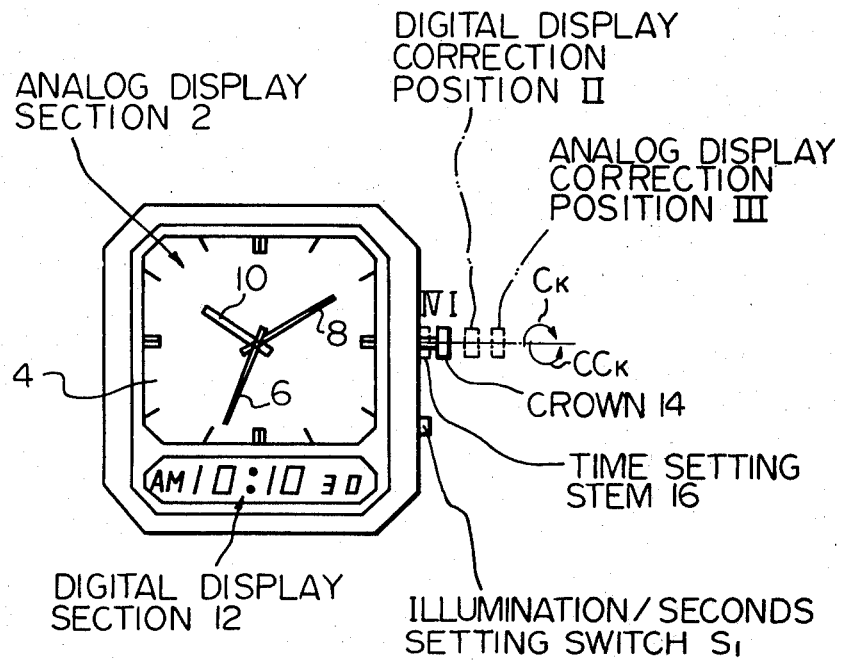
FIG. 1 is an external plan view of an electronic timepiece having analog and digital time displays and a correction system according to an embodiment of the present invention.

An embodiment of an electronic timepiece having an analog and a digital time display and also having a correction system according to the present invention will now be described, with reference to the appended drawings. Referring first to FIG. 1, an external view in plan is shown therein of an electronic timepiece provided with an analog display section 2, which is of conventional form and comprises a dial 4 and time indicating hands, i.e. seconds hand 6, minutes hand 8 and hours hand 10. The timepiece is also furnished with a digital display 12, comprising a liquid crystal display device, which is shown as indicating the current time hours, minutes and seconds. In this embodiment, the digital display 12 can also selectively display calendar data and stored alarm time data, depending upon the function mode which is currently selected. Numeral 14 denotes a crown, which is rotatable in the clockwise direction Ck (as viewed from the right of FIG. 1), or in the counter-clockwise direction CCk. Crown 14 is formed integrally with a time setting stem 16, and is also movable in the direction of the axis of stem 16, into four different axial positions, denoted as positions I, II, III and IV, in FIG. 1. In the first position I, designated as the normal operating position herein, time data is displayed by analog display 2, and time or other data is displayed by digital display section 12, and any rotation of crown 14 has no effect upon time or other data contents of the timepiece. In this state, if crown 14 is pulled butward to the second axial position II, then the digital display correction mode is entered. If at this time the digital display 12 is indicating the current time, as in FIG. 1, then rotation of crown 14 in the clockwise direction will result in the minutes data being incremented, at a rate dependent upon the rate of rotation of crown 14. When such incrementation exceeds a value of 59 minutes, then overflow occurs into the hours data of the digital display, and the hours thereof are incremented by one. By continued rotation of crown 14, the minutes and hours data can thus be incremented to any desired value. Rotation of crown 14 in the counterclockwise direction will result in decrementing the hours and minutes data. It can thus be seen that setting a desired time by such a crown is as easy and rapid as in the case of a conventional analog timepiece. For example, if it is desired to set a time of 1:59 AM, and if crown 14 is accidentally rotated too far in the clockwise direction so that a time of 2:00 AM is reached on digital display 12, then by slightly rotating crown 14 in the counterclockwise direction the digitally displayed time can be immediately set back to a value of 1:59 AM.

$S_1$ denotes an illumination/seconds setting switch. In the normal operating condition, i.e. with crown 14 in position I, actuation of switch $S_1$ will result in a dial illumination lamp (not shown in the drawings) being turned on. With crown 14 in the digital display correction position II, however, actuation of switch $S_1$ results in the seconds data appearing on digital display 12 being reset to zero. Thus, with crown 14 in position II, the seconds, minutes and hours data appearing on digital display 12 can be rapidly and accurately set to a desired current time value. Similarly, if the digital display 12 is in the calendar function mode, then the calendar data can be incremented or decremented to a desired value by rotation of crown 14 clockwise or counterclockwise.

If the crown 14 is pulled out by one step more in the axial direction, to position III, then the analog display correction mode is established. In this mode, the time indicated by hands 8 and 10 can be set to a desired value by rotation of crown 14 in the clockwise direction (to advance the displayed time) or in the counterclockwise direction (to retard the displayed time). Thus, correction of the analog display 2 is performed in precisely the same way as for the digital display 12, and in a manner which is very familiar and simple for the great majority of users, since consecutive correction of the minutes and hours time data is performed in a continuous and reversible manner.

In the analog display correction position III the motion of seconds hand 6 is halted. Thus, by suitably selecting the instant at which crown 14 is pulled out to position III, it is possible to set both the seconds as well as the minutes and hours of the analog display 2 to a precise time.

If the crown 14 is in the normal operating position I, and is depressed inward to the position IV and then released, crown 14 will return automatically to position I. Each time this operation is performed, the function mode of digital display section 12 will be changed over, i.e. switched over in a cyclic manner from the current time display to the calendar display mode, and from the calendar display mode to the alarm time display mode. In the latter function mode, actuation of pushbutton switch $S_1$ will result in the alarm function being set either on or off, i.e. in this function mode, switch $S_1$ serves as an alarm ON/OFF switch.

The mechanical components which are associated with the correction system of the embodiment of FIG. 1 will now be described, with reference to FIG. 2 and FIGS. 3 to 5. As stated above, the crown 14, and hence the time setting stem 16, can be moved axially into each of three stable positions. This is achieved by the action of a setting lever 20 and a setting lever jumper (the latter not being shown in the drawings). Such an arrangement is commonly used in analog display timepieces of the prior art, and hence will not be described in great detail. A clutch wheel 22 is mounted on portion 24 of time setting stem 16 which is of rectangular cross-section, such as to be movable axially with respect to stem 16 and is also rotatable together with stem 16, i.e. wheel 22 is slidably mounted on time setting stem 16. One end 27 of a yoke 26 is engaged with the clutch wheel 22, thus yoke 26 is moved when time setting stem 16 is moved in the axial direction. It should be noted that the term "external operating means", as used with respect to the present invention, designates the assembly comprising crown 14, time setting stem 16, setting lever 20, clutch wheel 22, and the yoke 26. For the condition which is shown in the diagrams, time setting stem 16 is in the first position I, i.e. the normal operating position. If crown 14 is now pulled out to the second position II (note that this is the leftward position with respect to FIG. 3), then the time setting stem 16 is moved to position II, so that setting lever 20 is rotated through an angle clockwise about shaft 28. As a result, a pin 30 which is mounted on setting lever 20 is moved within a curved slot 32 in yoke 26, to a position 34 indicated by a broken line outline. Yoke 26 is thereby rotated clockwise about the axis of shaft 40, clutch wheel 22 is moved upward, and a gearwheel 42 on clutch wheel 22 is caused to mesh with a sliding pinion 46 of a switch transmission wheel 48, as indicated by the broken-line outline 43 in FIG. 3.

In this position, if crown 3 is rotated clockwise or counterclockwise, then switch transmission wheel 48 is correspondingly rotated clockwise or counterclockwise, by being driven through clutch wheel 22.

Figure 4:
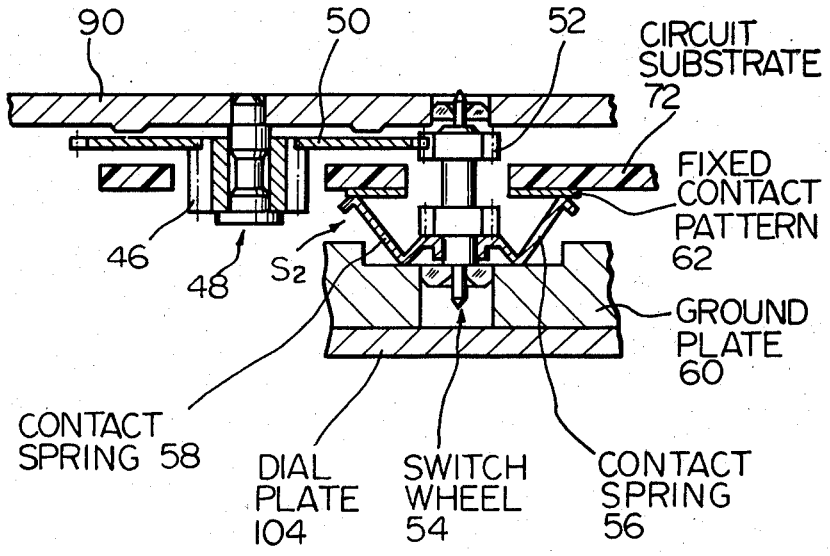
FIG. 4 is a partial cross-sectional view in elevation taken through a line B—B in the drawing of FIG. 2.

A gearwheel 50 of switch transmission wheel 48 meshes with a sliding pinion 52 which is on a switch wheel 54, as is shown in FIG. 4, and serves to provide a rotational speed step-up of 8 times with rotation of clutch wheel 22 and switch wheel 54. A pair of contact springs 56 and 58 constituting a switch rotor are attached to switch wheel 54. Each of these contact springs, which are in a Z-shape as shown, are connected to a high logic level potential, which will be designated as Vdd herein. This is achieved by sliding contact between the contact springs and a ground plate 60. The tips of contact springs 56 and 58 successively contact portions of a fixed contact pattern, part of which is denoted by numeral 62, which is formed upon a circuit substrate 72.

Figure 6:
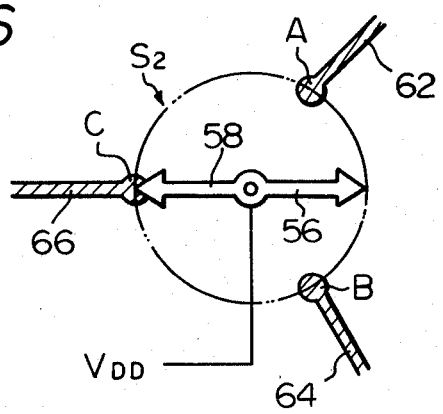
FIG. 6 is a simplified drawing illustrating an embodiment of a correction signal generating switch according to the present invention.

A correction signal generating switch is thereby formed, which will be referred to as $S_2$ herein. This switch is shown in simplified form in FIG. 6. As shown, portions of contact pattern leads 62, 64 and 66 are formed into fixed contacts, denoted by the letters A, B and C, which are arranged on the circular path traced out by rotation of the tips of contact springs 56 and 58. Thus, the leads 62, 64 and 66 are successively connected to potential Vdd. Each time switch wheel 54 is rotated once, each of the contacts A, B and C is connected to Vdd twice, by springs 56 and 58, so that a total of six switching pulses are produced by switch $S_2$ for each rotation of wheel 54. In addition, switch wheel 54 is rotated approximately 8 times for each rotation of crown 14. Thus, approximately 50 switching pulses are produced in response to each rotation of crown 14. If these pulses are used as correction signal pulses for correcting the minutes (and, by overflow past 59 minutes, the hours) of digital display 12, then approximately 50 minutes of correction can be performed for each rotation of the crown. Thus, correction can be rapidly performed, as for correcting an analog display with time indicating hands.

If crown 14 is pulled out one more step, to the position III, then the coupling lever 20 is further rotated clockwise, and pin 30 moves to the position which is designated as 36, while yolk 26 is rotated counterclockwise. As a result, yolk 26 moves clutch wheel 22 in a downward direction (as viewed in FIG. 2). A gearwheel 44, which is on the opposite end of clutch wheel 22 to gearwheel 42, is moved to a position denoted by numeral 45, thereby meshing with the setting wheel 76. Setting wheel 76 meshes with a setting transmission wheel 78, mounted in the baseplate 80. Setting transmission wheel 78 also meshes with minutes wheel 82.

Figure 5:
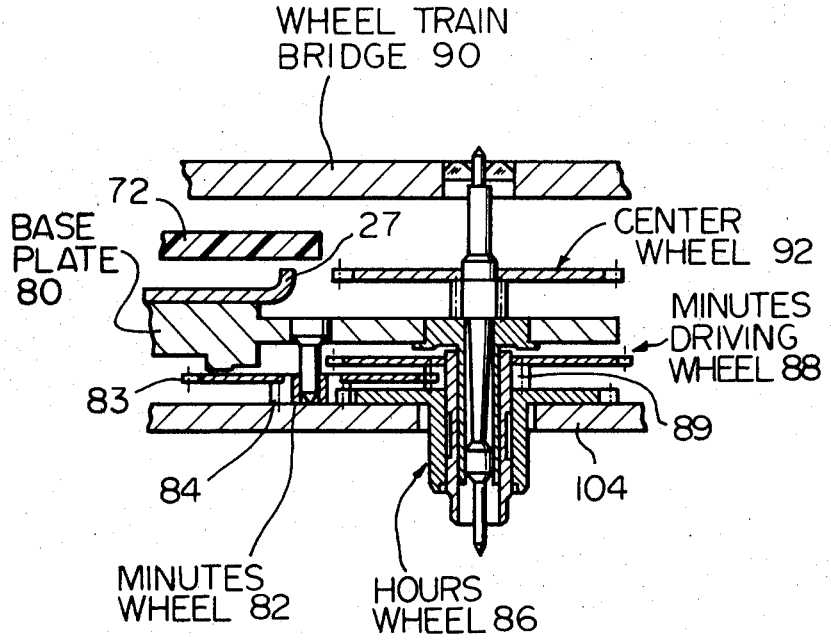
FIG. 5 is a partial cross-sectional view in elevation taken through a line C—C in FIG. 2.

As shown in FIG. 5, a sliding pinion 84 on the minutes wheel 82 meshes with an hours wheel 86, while the minutes wheel gearwheel 83 meshes with sliding pinion 89 of the minute hand wheel 88. The setting wheel 76, setting transmission wheel 78 and the minutes wheel 82 constitute in combination the analog display time setting means. If crown 14 is rotated clockwise or counter clockwise in this condition, then correction of the time displayed by hours hand 10 and minutes hand 8 can be performed by rotation of the hours hand wheel 86 and minutes hand wheel 88 in response to rotation of time setting stem 16, in the same way as for a conventional analog display timepiece. The minutes hand is rotated through approximately 60 minutes, i.e. a change of one hour in the hours hand setting is achieved, for each revolution of crown 14.

While such correction of the analog display is being performed, a brake portion 27 of yoke 26 is pressed against the seconds hand wheel 92, thereby preventing rotation of the seconds hand wheel 92, so that seconds hand 6 of the timepiece is halted.

Figure 2:
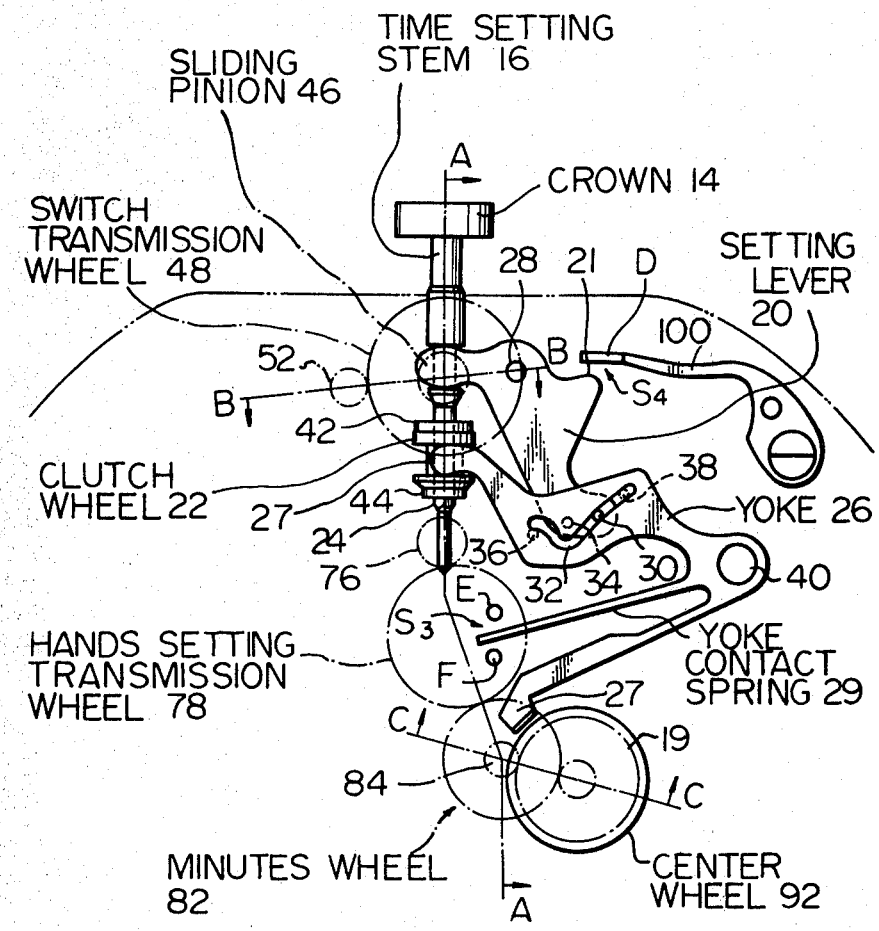
FIG. 2 is a partial plan view of the interior of the timepiece of FIG. 1, illustrating the major mechanical components of an embodiment of a correction system according to the present invention.

As shown in FIG. 2, a contact arm 32 is formed integrally with yoke 26. This contact arm 32, in conjunction with fixed contacts denoted by the letters E and F, constitates a correction control switch $S_3$. When the time setting stem 16 is in the second stable position II, i.e. in the digital display correction position, then contact arm 32 touches the fixed contact E, while when stem 16 is in the third position III, i.e. in the analog display correction position, the contact arm 32 touches fixed contact F. Yoke 26 is connected to the high level potential Vdd.

If we now assume that crown 14 is in the normal operating position I, and is then pushed inward to position IV shown in FIG. 1, then setting lever 20 is rotated clockwise so that pin 30 goes to the position denoted by numeral 38. However, the shape of curved slot 32 is such that in this case yoke 26 does not move. A cam-shaped portion 21 of setting lever 20 is thereby rotated counterclockwise, and thereby touches a fixed contact D, which is thereby connected to the Vdd potential. This cam-shaped portion 21 of setting lever 20 together with contact D constitutes a function mode selector switch $S_4$. When crown 14 is the released, the crown 14 and setting lever 20 return to the normal position, i.e. that shown in the drawings, in response to spring means which are omitted from the drawings.

Figure 3:
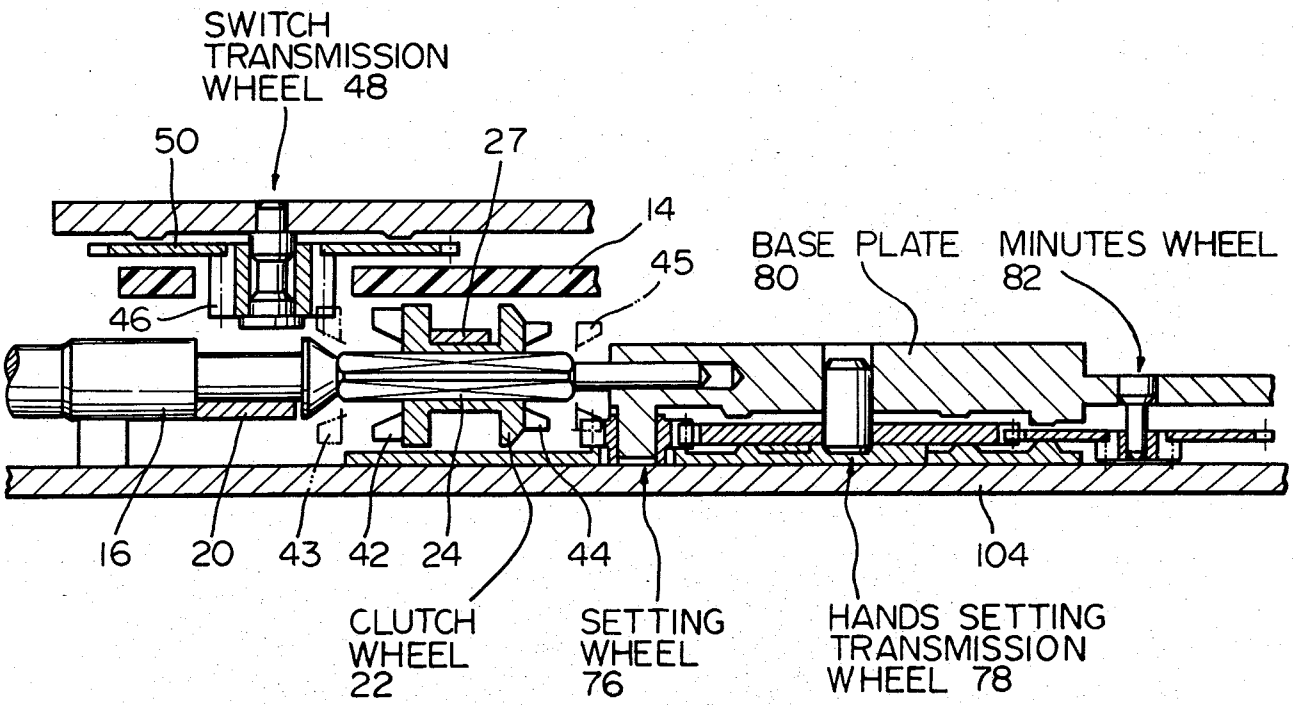
FIG. 3 is a partial cross-sectional view in elevation taken through a line A—A of the drawing of FIG. 2.

In FIGS. 3 and 5, numeral 90 denotes a wheel train bridge, and numeral 104 and dial plate.

Figures 7, 7A:
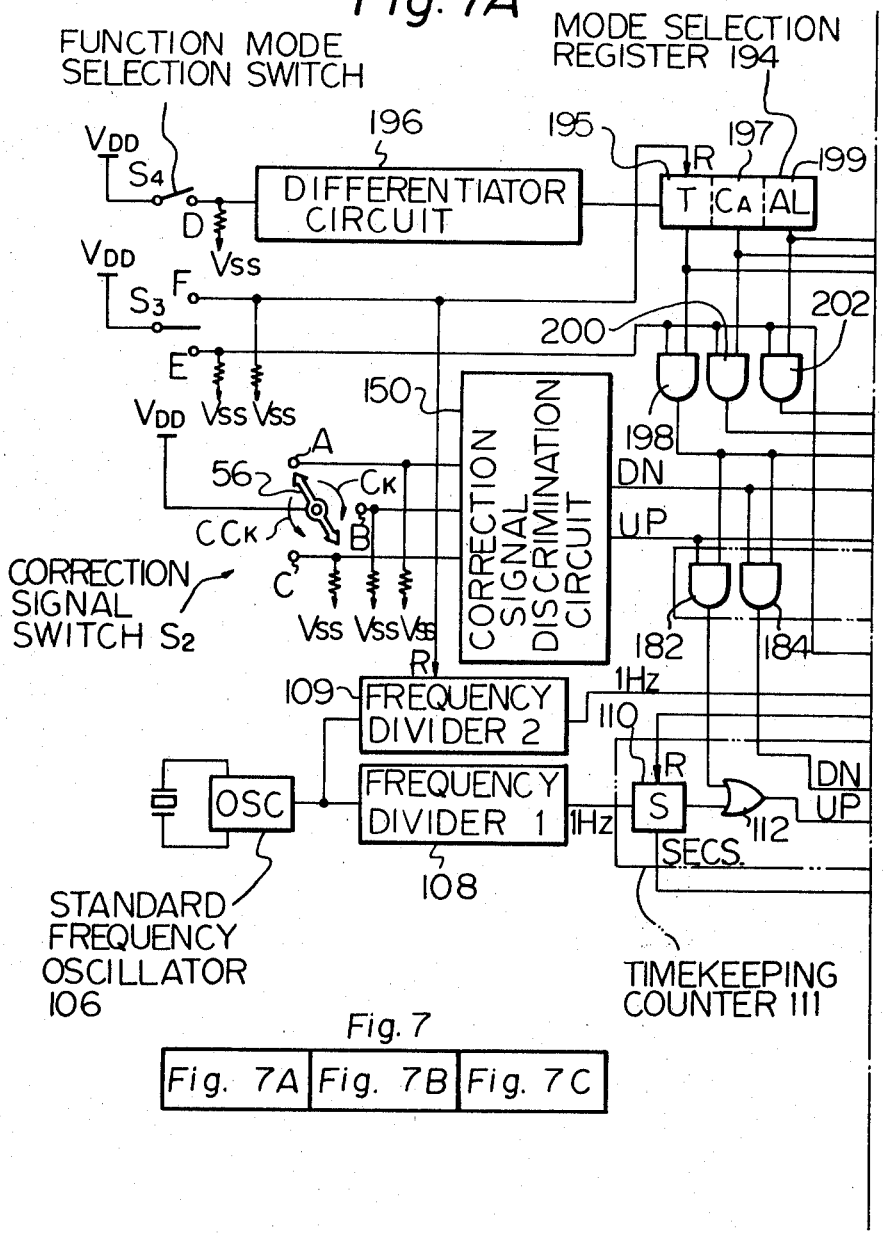
FIGS. 7A–7C are a block diagram of an example of a timepiece circuit for the embodiment of FIG. 1 to FIG. 5.
Figure 7B:
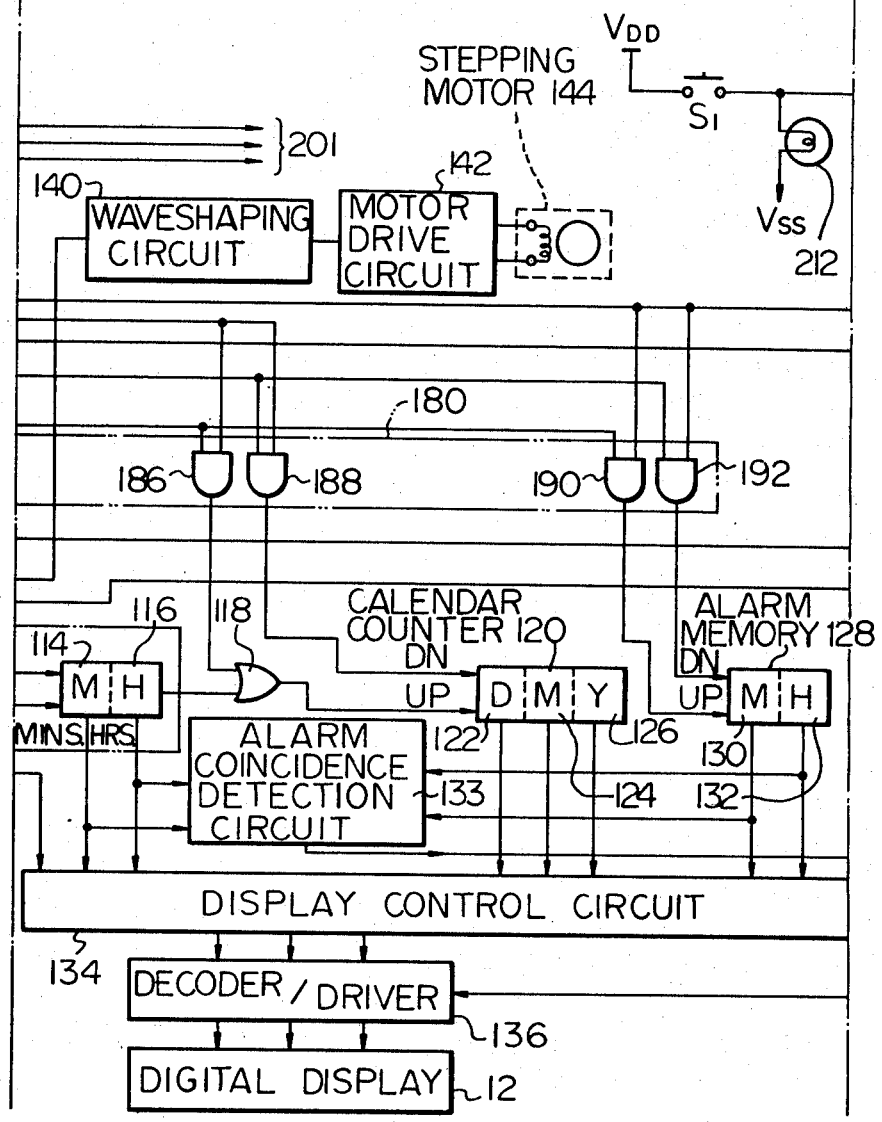
Figure 7C:
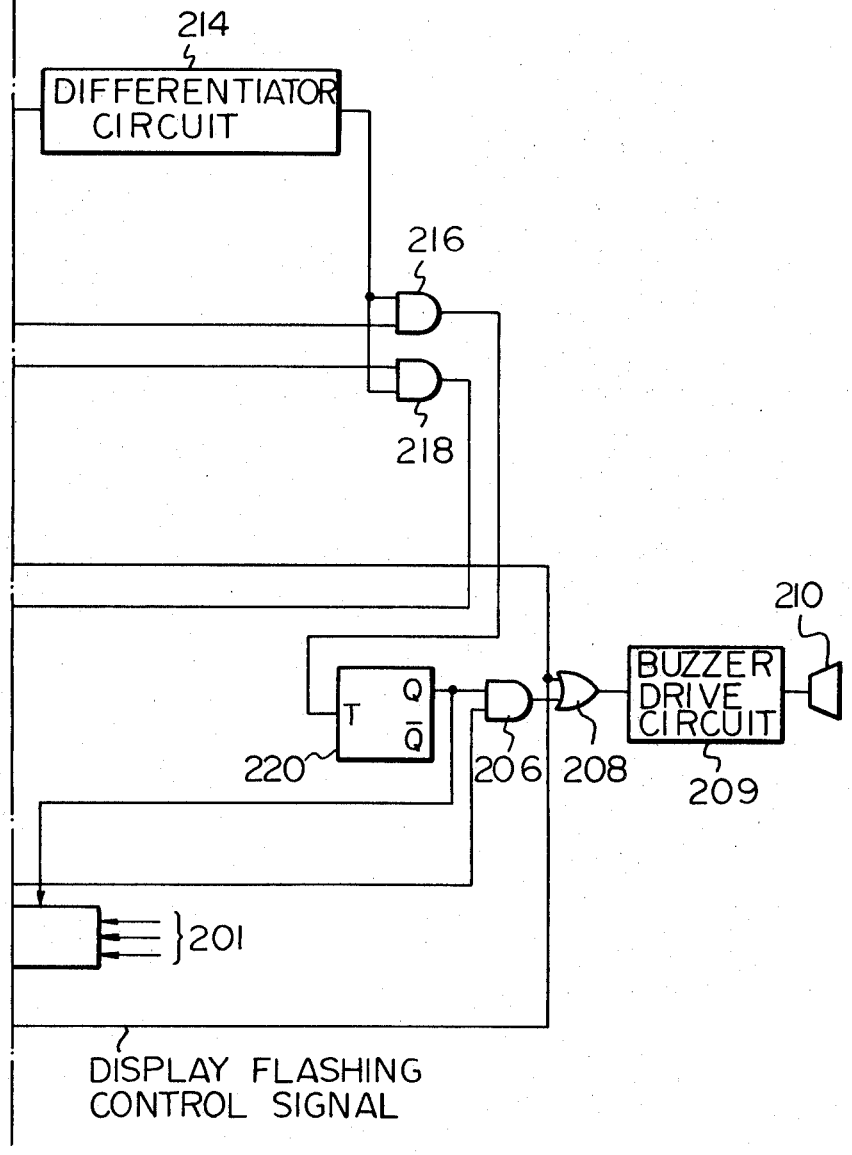

The electronic circuit of the embodiment of FIGS. 1 to 6 will now be described, with reference to FIG. 7 and FIG. 9. In FIG. 7, numeral 106 denotes a standard frequency signal source comprising a quartz crystal oscillator which produces an output at a frequency of 32.768 kiloherz, which is input to two frequency dividers 108 and 109, each of which performs frequency division down to 1 Hz. The 1 Hz output from frequency divider 108 is input to a timekeeping counter circuit 111, which comprises a seconds counter 110, whose output is applied through an OR gate 112 to a minutes counter 114 connected in cascade with an hours counter 116. Counters 114 and 116 are reversible, i.e. are UP/DOWN counters, which count up in response to the signal UP from OR gate 112 and which count down in response to a signal DN, produced as described hereinafter. Each time the contents of counter 114 count up from 59 through zero, the contents of hours counter 116 are incremented by one, while each time the contents of counter 114 count down from zero through 59, the contents of hours counter 116 are decremented by one.

The output from hours counter 116 is applied through an OR gate 118 to a days counter 122 in a calendar counter 120, as an up count signal UP. Calendar counter 120 comprises days counter 122, months counter 124 and years counter 126 connected in cascade. In order to simplify the description, the various circuit elements whereby carryover from days counter 122 to the months counter 124 are suitably controlled will not be described.

Numeral 128 denotes an alarm memory circuit, which serves to store a predetermined alarm time in an hours memory 132 and a minutes memory 130. Alarm memory circuit 128 also comprises a reversible counter, and receives as inputs an up count signal UP and a down count signal DN as described hereinafter.

The contents of alarm memory 128 and the hours and minutes of current time, from counters 114 and 116, are compared by means of alarm coincidence detection circuit 133. When coincidence between the alarm and current times is detected thereby, an output is produced and applied through gates 206 and 208 to a buzzer drive circuit 209, whereby a buzzer 210 is activated to produce an alarm warning.

The contents of either the timekeeping counter 111, the calendar counter 120, or the alarm time memory 128 are selected by means of display control circuit 134 and applied therefrom to a decoder driver circuit 136, output signals from which drive a liquid crystal display device comprising digital display 12, to display the data concerned in digital form.

The 1 Hz output pulses from frequency divider 2 are shaped into suitable form for stepping motor drive purposes by means of a waveshaping circuit 140, the output signals from which are applied through a motor drive circuit 142 to drive stepping motor 144. The second wheel 92, the minutes wheel 88 and hours hand wheel 86 are rotated thereby, to provide time indication by hands 6, 8 and 10 of the analog display 2.

The circuitry associated with the correction system of this embodiment will now be described. As described above, rotation of correction signal switch $S_2$ causes the contacts A, B and C of switch $S_2$ to be momentarily connected to the high potential $V_{dd}$. As can be seen, if the rotor carrying contact springs 56 and 58 of switch $S_2$ is rotated in the clockwise direction, designated as Ck, then switching pulses will be produced from the fixed contacts of switch $S_2$ in the sequence A, B, C. If the contact springs are rotated in the counterclockwise direction, CCk, then switching pulses will be produced in the sequence A, C, B. This is illustrated in the leftmost portion (A) of FIG. 9, in which the pulses produced from fixed contacts A, B and C are designated by the letters a, b and c, for the case of rotation in the clockwise direction. The rightmost portion (B) of FIG. 9 shows the pulses for the case in which rotation is in the counterclockwise direction.

The pulses thus produced by switch $S_2$ are input to a correction signal waveshaping circuit 150, the operation of which will be described hereinafter. Depending upon the direction of rotation of crown 14, and hence the contact springs of switch $S_2$, a correction signal comprising a pulse train UP or a pulse train DN will be formed, having the waveforms shown in FIG. 9.

Figure 8:
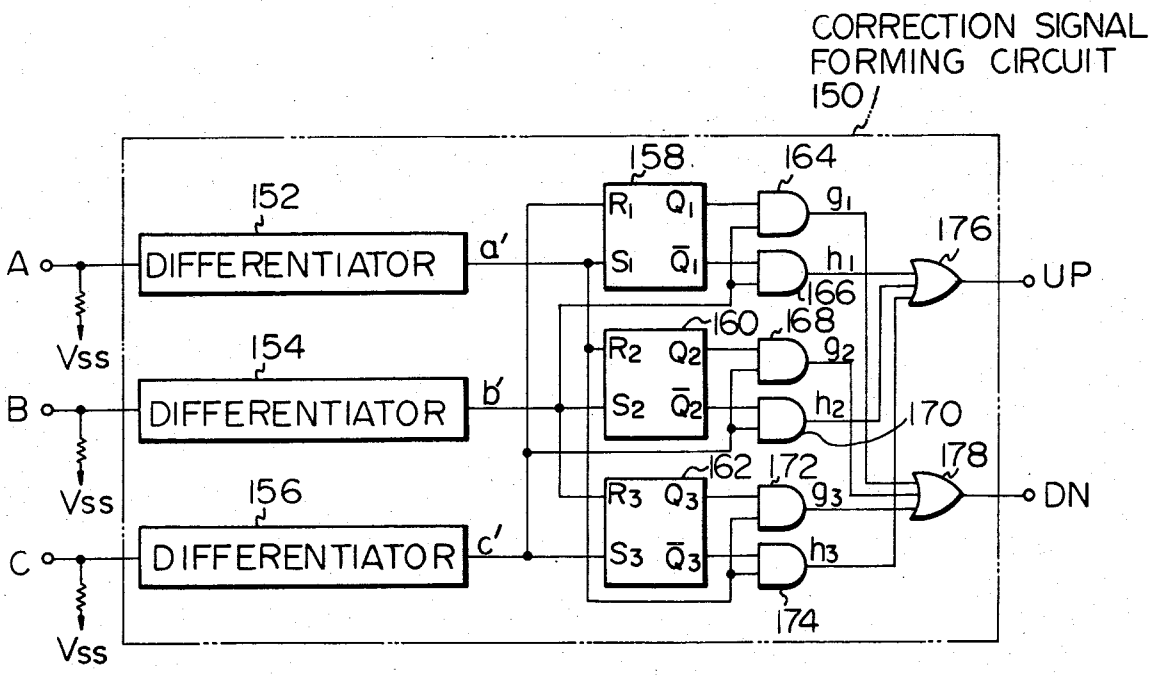
FIG. 8 is a block circuit diagram of a correction signal discrimination circuit block in the drawing of FIG. 7.

The configuration of the correction signal waveshaping circuit 150 is shown in FIG. 8. Numerals 152, 154 and 156 denote three differentiator circuits, which produce relatively narrow width pulses, denoted as a', b' and c', from the pulses a, b and c from switch $S_2$. Circuit 150 further includes three set/reset flip-flops 158, 160 and 162. The output of differentiator 152 is coupled to the set and reset terminals of flip-flops (hereinafter abbreviated to FF) 158 and 160 respectively. The output of differentiator 154 is applied to the set and reset terminals of FF 160 and 162 respectively. The output of differentiator 156 is applied to the set and reset terminals of FF 162 and 158 respectively. The circuit further comprises a set of AND gates. The outputs Q1, Q2 and Q3 from FF 158, 160 and 162 respectively are input to AND gates 164, 168 and 172. The inverting outputs $\overline{Q1}$, $\overline{Q2}$ and $\overline{Q3}$ are input to AND gates 166, 170 and 174 respectively. The signal a' from differentiator 152 is input to AND gates 172 and 174. The signal b' from differentiator 154 is input to AND gates 164 and 166. The signal c' from differentiator 156 is input to AND gates 168 and 170.

The outputs from AND gate group are applied to two OR gates 176 and 178. The outputs from AND gates 164, 168 and 172 are input to the OR gate 178, which produces the down count signal DN. The outputs from AND gates 166, 170 and 174 are input to the OR gate 176, which produces the up count signal UP.

Figure 9:
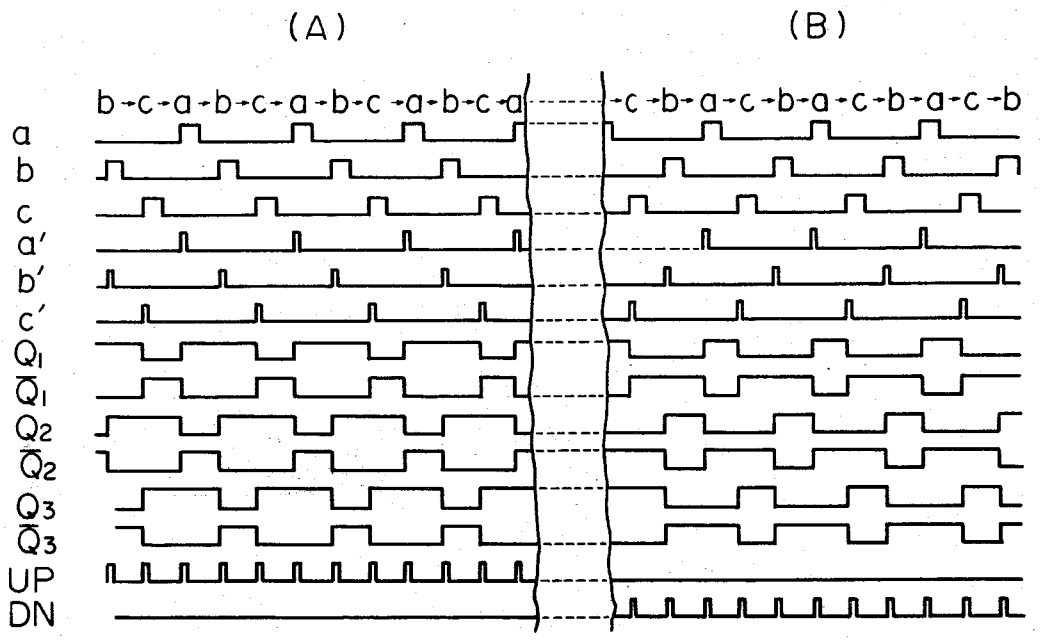
FIG. 9 is a waveform diagram for illustrating the operation of the correction signal generating system of the embodiment of FIGS. 1 to 8.

The sequence in which the outputs from FF 158 to 162 vary between the high logic level potential Vdd and the low logic level potential Vss will be apparent from FIG. 9. The logical relationships between the output signals $g_1$, $h_1$, $g_2$, $h_2$, $g_3$ and $h_3$ from the AND gates 164, 166, 168, 170, 172 and 174 respectively are as follows, with respect to the signals a, b and c:

$g_1 = Q1.b$
$g_2 = Q2.c$
$g_3 = Q3.a$
$h_1 = \overline{Q1}.b$
$h_2 = \overline{Q2}.c$
$h_3 = \overline{Q3}.a$ The logical relationships between the up count signal UP and the down count signal DN are as follows:

$$UP = g_1 + g_2 + g_3 = Q1.b + Q2.c + Q3.a$$

$$DN = h_1 + h_2 + h_3 = \overline{Q1}.b + \overline{Q2}.c + \overline{Q3}.a$$

Thus, when crown 14 is rotated clockwise, i.e. in a direction which would advance the time indicating hands in the analog correction mode, the up count correction signal UP is output as shown in (A) of FIG. 9, while when the crown 14 is rotated in the counterclockwise direction, the down count signal DN, for decrementing the digital display contents, is output.

The up count signal UP and the down count signal DN are applied to a set of AND gates 180. Signal UP is input to AND gates 182, 186 and 190. Signal DN is input to AND gates 184, 188 and 192. AND gate group will be referred to as the correction signal input gate group. When AND gate 182 is enabled, the UP signal is transferred therethrough and through OR gate 112 to the up count terminal of minutes counter 114. When AND gate 186 is enabled, the UP signal is transferred therethrough to the UP count terminal of days counter 122. When AND gate 190 is enabled, the UP signal is transferred therethrough to the up count terminal of alarm memory minutes counter 130. When AND gate 184 is enabled, the DN signal is transferred to the down count terminal of minutes counter 114. When AND gate 188 is enabled, the DN signal is transferred to the down count terminal of days counter 122. When AND gate 192 is enabled, the DN signal is transferred to the down count terminal of minutes counter 130 in alarm memory circuit 128.

The control of gate group 180 is performed by signals emitted by a set of AND gates 198, 200 and 202, which serve to select or inhibit signals generated by mode selection register 194. When switch S3 is set such that fixed contact E is at the high potential Vdd, i.e. when crown 14 is pulled out to the digit display correction position II in FIG. 1, then AND gates 198, 200 and 202 are enabled. At this time, if the digital display is in the current time display mode, then a high logic level output will be produced from section 195 of mode selection register 194. As a result, gates 182 and 184 will be enabled to transfer the UP or DN signal pulses to minutes counter 114, if crown 14 is rotated. Numeral 196 denotes a differentiator circuit which is coupled to receive signals produced by actuation of function mode selection switch $S_4$. Each time crown 14 is depressed inward to position IV in FIG. 1, the fixed contact D is raised to the Vdd potential, whereby a pulse is output from differentiator 196. This acts to change over the contents of mode selection register 194, i.e. if a high level output is currently being output from section 195, this will go to the lwo logic level potential and an output will be produced from section 197, and so on. When the output from stage 197 is at the high logic level, the an output is produced from AND gate 200 which enables gates 186 and 188, so that the UP and DN signals can be transferred to the up and down count terminals respectively of the days counter 122, in response to rotation of crown 14.

Similarly, if function mode selection switch $S_4$ is again actuated, an output at the high logic level is output from stage 199 of register 194, so that an output is produced from AND gate 202. This enables AND gates 190 and 192, so that the DN and UP signals can be transferred to the up and down count terminals of the minutes counter 130 in alarm memory circuit 128. Thus, the stored alarm time can be altered by rotation of crown 14.

In the digital display correction mode, if the current time correction condition has been selected, then the output from AND gate 198, in addition to enabling AND gates 182 and 184, also enables an AND gate 218. In this condition, actuation of switch $S_1$ will cause a pulse to be emitted by differentiator circuit 214, which is transferred through AND gate 218 and applied to a reset terminal of the seconds counter 110.

When the alarm time correction condition has been selected, then the output from AND gate 202, in addition to enabling the AND gates 190 and 192 also enables an AND gate 216. As a result, each time switch S1 is actuated in this condition, a pulse from differentiator circuit 214 is transferred through AND gate 218 and applied to the toggle input of a toggle-type flip-flop 220. Thus, the logic level of the Q output of this flip-flop changes over each time switch S1 is actuated, so that AND gate 206, which is controlled by the output from FF 220, can be enabled or inhibited as desired. Since AND gate 206 serves to transfer the alarm coincidence detection circuit output signal to buzzer drive circuit 209, it will be apparent that the alarm function can be either enabled or inhibited, by suitably actuating switch S1 when the alarm time correction condition has been selected, in the digital display correction mode.

Selection of a particular function to be corrected is indicated by the corresponding data appearing on digital display 12 in a flashing manner. The selection of display for a particular function mode, e.g. current time, calendar or alarm time, is performed by means of signals output from stages 195, 197 and 199 of mode selection register 194, denoted by numeral 201 in FIG. 7. These signals are applied to display control circuit 134, to select the output of timekeeping counter 111, calendar counter 120, or alarm memory 128 to be displayed by digital display 12. Flashing of the display, to indicate the correction condition, is achieved by connecting terminal E of switch S2 to a display flashing control input of decoder driver circuit 136, as shown. Thus, when crown 14 is pulled out to positions II of FIG. 1, a high logic level potential will be applied as a display flashing control signal to decoder driver 136.

When crown 14 is pulled out to position III of FIG. 1, then contact F of switch S3 is connected to the high logic level potential. Since terminal F is coupled to reset terminals of the mode selection register 194 and frequency divider 109, the digital display is set to the current time display condition, by an output signal from stage 195 of mode selection register 194, while the output of 1 Hz pulses from frequency divider 109 is halted. As a result, movement of the stepping motor 144, and hence of the hands 6, 8 and 10 of the analog display, is halted.

Numeral 212 denotes a dial illumination lamp, which is turned on by actuation of switch S1.

From the above description of the preferred embodiment, it will be apparent that a correction system for an electronic timepiece according to the present invention will be apparent that such a correction system, incorporated into a timepiece having both analog and digital displays, provides a high degree of ease and rapidity of correction of both digital and analog data. This is possible since an identical rotatable external operating member is actuated both when correction of the analog time data is to be performed and when digital time data correction is to be performed. In addition, it can be arranged that, as in the described embodiment, the direction of rotation of this operating member to achieve advancement of the analog time data is identical to the direction of rotation of that member for incrementation of the digital time data. Moreover, as in the preferred embodiment, selection of either a normal operating state, an analog display correction state, and a digital display correction state can be performed by simply setting the external rotatable operating member to different predetermined positions along its axis of rotation. Furthermore, as in the preferred embodiment, a switch can be coupled to the rotatable external operating member such as to be responsive to momentary depressions thereof for producing signals which select various function modes of the timepiece that are displayed on the digital display. It will therefore be apparent that a corrections system according to the present invention for an electronic timepiece having combined analog and digital displays represents a significant improvement over prior art correction systems for such timepieces, with respect to simplicity of operation, rapidity of operation, and minimization of the number of external operating members necessary to correct the analog and digital display contents.

From the preceding description, it will be apparent that the objectives set forth for the present invention are effectively attained. Since various changes and modifications to the above construction may be made without departing from the spirit and scope of the present invention, it is intended that all matter contained in the above description or shown in the accompanying drawings shall be interpreted as illustrative, and not in a limiting sense. The appended claims are intended to cover all of the generic and specific features of the invention described hereinabove.

What is claimed is:

1. A correction system for an electronic timepiece having an analog display including time indicating hands for indicating current time data and a digital display for indicating at least current time data, a stepping motor coupled through a wheel train to said time indicating hands to drive said analog display, and timekeeping circuit means and drive circuit means for generating signals to drive said stepping motor and to drive said digital display, comprising:

a rotatable external operating member movable in an axial direction to selectively establish an analog correction mode of operation and a digital correction mode of operation in dependence on a selected axial position of said external operating member;

a hands adjusting mechanism for correcting the current time data displayed by said time indicating hands;

means for coupling said external operating member mechanically to said hands adjusting mechanism in response to the establishment of said analog correction mode of operation in which rotation of said external operating member in a first direction acts to advance a time displayed by said time indicating hands and in which rotation of said external operating member in a second direction opposite to said first direction acts to retard said time displayed by said time indicating hands;

correction switch means including a rotor and responsive to rotation of said rotor in a first direction for producing a first correction signal and responsive to rotation of said rotor in a second direction opposite to said first direction for producing a second correction signal; and means for coupling said correction switch means to be rotated by said external operating member and for selectively applying said first and second correction signals to said timekeeping circuit means, in response to the establishment of said digital correction mode of operation in which said timekeeping circuit means is responsive to said first correction signal for incrementing time data produced thereby and responsive to said second correction signal for decrementing time data produced thereby, whereby time data displayed by said digital display is advanced in response to said first correction signal and is retarded in response to said second correction signal, when said timepiece is in said digital display correction mode of operation;

wherein said correction switch means comprises at least one movable contact forming part of said rotor and a plurality of fixed contacts, and wherein said rotor is coupled to a source of a predetermined logic level potential whereby said fixed contacts are sequentially and momentarily connected to said logic level potential as said rotor is rotated, and further comprising correction signal discrimination circuit means coupled to said fixed contacts and responsive to signals appearing on said fixed contacts in a sequence resulting from rotation of said rotor in said first direction for producing said first correction signal and further responsive to signals appearing on said fixed contacts in a sequence resulting from rotation of said rotor in said second direction for producing said second correction signal; and wherein said correction switch means includes at least three fixed contacts, and wherein said correction signal discrimination circuit means comprises:

a first set/reset flip-flop coupled to be set by signals appearing on a first one of said fixed contacts and reset by signals appearing on a third one of said fixed contacts;

a second set/reset flip-flop coupled to be set by signals appearing on a second one of said fixed contacts and reset by signals appearing on a second one of said fixed contacts;

a third set/reset flip-flop coupled to be set by signals appearing on said third fixed contact and reset by signals appearing on said second one of said fixed contacts;

a first logic AND gate coupled to receive a non-inverting output from said first flip-flop and to receive signals from said second fixed contact;

a second logic AND gate coupled to receive an inverting output from said first flip-flop and to receive signals from said second fixed contact;

a third logic AND gate coupled to receive a non-inverting output from said second flip-flop and to receive signals from said third fixed contact;

a fourth logic AND gate coupled to receive an inverting output from said second flip-flop and to receive signals from said third fixed contact;

a fifth logic AND gate coupled to receive a non-inverting output from said third flip-flop and to receive signals from said first fixed contact;

a sixth logic AND gate coupled to receive an inverting output from said third flip-flop and to receive signals from said first fixed contact;

a first logic OR gate coupled to receive output signals from said second, fourth and sixth logic AND gates, for thereby producing said first correction signal comprising a train of pulses having a frequency determined by the rate of rotation of said external operating member; and a second logic OR gate coupled to receive output signals from said first, third and fifth logic AND gates, for thereby producing said second correction signal, comprising a train of pulses having a frequency determined by the rate of rotation of said external operating member.

2. A correction system according to claim 1, wherein said external operating member is movable to each of at least three different stable positions along the axis of rotation thereof, and whereby said timepiece operates in a normal time display mode when said external operating member is in a first one of said axial positions, and whereby said correction signal generating switch means is coupled to said external operating member and said correction signals are applied to said timekeeping circuit in a second one of said axial positions, and further whereby said external operating member is coupled to said wheel train of said analog display when said external operating member is in a third one of said axial positions.

3. A correction system according to claim 2, in which said timepiece is operable in a plurality of function modes including a function mode in which current time is displayed by said digital display, and further comprising function mode selection switch means for generating an output signal, and mode selection circuit means responsive to said output signal from said function mode selection switch for changing over the data displayed by said digital display from data corresponding to one of said function modes to data corresponding to another of said function modes, and further wherein data corresponding to a selected function mode is alterable by establishing said digital display correction mode and rotation of said external operating member.

4. A correction system according to claim 3, in which said function mode selection switch means is responsive to depression of said external operating member in a direction which is inward with respect to the body of said timepiece, for producing said output signal.

5. A correction system according to claim 3, and further comprising switch means coupled to said external operating member, and responsive to said external operating member being set to said third stable position for producing an output signal, and wherein said mode selection circuit means is responsive to said output signal for establishing said function mode in which current time is displayed by said digital display.

6. A correction system according to claim 1, in which said correction switch means is actuated to produce said first correction signal for incrementing data contents of said digital display when said external operating member is rotated in said first direction of rotation, and in which said correction switch means is actuated to produce said second correction signal for decrementing data contents of said digital display when said external operating member is rotated in said second direction of rotation.

7. A correction system according to claim 1, in which said external operating member comprises a timepiece crown attached to a time setting stem.

8. A correction system according to claim 7, and further comprising a clutch wheel slidably mounted on said time setting stem and adapted to be rotated in unison therewith, and having first engaging means mounted at one end thereof concentric with the axis of rotation of said time setting stem and second engaging means mounted at the axially opposite end thereof, and moreover comprising setting means mechanically linked to said clutch wheel and said time setting stem for controlling the position of said clutch wheel in accordance with movement of said time setting stem in the axial direction, wherein said first engaging means of said clutch wheel engages with said correction switch means when said crown is moved to a first axial position whereby said correction switch means can be actuated to produce said first or said second correction signal by rotation of said crown, and wherein said second engaging means of said clutch wheel engages with said wheel train of said analog display when said crown is moved to a second axial position, whereby said time indicating hands can be advanced or retarded by rotation of said crown.

9. A correction system according to claim 1, in which said timekeeping circuit means comprises a standard frequency signal source, a seconds counter coupled to receive an output signal from said standard frequency signal source, and a plurality of reversible counters connected in cascade and coupled to receive an output signal from said seconds counter as an input signal, said reversible counters being responsive to said first correction signal for counting in an upward direction and to said second correction signal for counting in a downward direction.

10. A correction system according to claim 9, and further comprising a divider coupled to receive an output signal from said standard frequency signal source, and moreover comprising waveshaping circuit means coupled to receive an output signal from said divider and motor drive circuit means responsive to an output signal from said waveshaping circuit means for generating drive signals to drive said stepping motor.

11. A correction system for an electronic timepiece having an analog display including time indicating hands for indicating current time data and a digital display for indicating at least current time data, a stepping motor coupled through a wheel train to said time indicating hands to drive said analog display, and timekeeping circuit means and drive circuit means for generating signals to drive said stepping motor and to drive said digital display, comprising:

a rotatable external operating member movable in an axial direction to selectively establish an analog correction mode of operation and a digital correction mode of operation in dependence on a selected axial position of said external operating member;

a hands adjusting mechanism for correcting the current time data displayed by said time indicating hands;

means for coupling said external operating member mechanically to said hands adjusting mechanism in response to the establishment of said analog correction mode of operation in which rotation of said external operating member in a first direction acts to advance a time displayed by said time indicating hands and in which rotation of said external operating member in a second direction opposite to said first direction acts to retard said time displayed by said time indicating hands;

correction switch means including a rotor and responsive to rotation of said rotor in a first direction for producing a first correction signal and responsive to rotation of said rotor in a second direction opposite to said first direction for producing a second correction signal; and means for coupling said correction switch means to be rotated by said external operating member and for selectively applying said first and second correction signals to said timekeeping circuit means, in response to the establishment of said digital correction mode of operation in which said timekeeping circuit means is responsive to said first correction signal for incrementing time data produced thereby and responsive to said second correction signal for decrementing time data produced thereby, whereby time data displayed by said digital display is advanced in response to said first correction signal and is retarded in response to said second correction signal, when said timepiece is in said digital display correction mode of operation;

in which said external operating member comprises a timepiece crown attached to a time setting stem; and further comprising a clutch wheel slidably mounted on said time setting stem and adapted to be rotated in unison therewith, and having first engaging means mounted at one end thereof concentric with the axis of rotation of said time setting stem and second engaging means mounted at the axially opposite end thereof, and moreover comprising setting means mechanically linked to said clutch wheel and said time setting stem for controlling the position of said clutch wheel in accordance with movement of said time setting stem in the axial direction, wherein said first engaging means of said clutch wheel engages with said correction switch means when said crown is moved to a first axial position whereby said correction switch means can be actuated to produce said first or said second correction signal by rotation of said crown, and wherein said second engaging means of said clutch wheel engages with said wheel train of said analog display when said crown is moved to a second axial position, whereby said time indicating hands can be advanced or retarded by rotation of said crown.

12. A correction system according to claim 11, in which said timekeeping circuit means comprises a standard frequency signal source, a seconds counter coupled to receive an output signal from said standard frequency signal source, and a plurality of reversible counters connected in cascade and coupled to receive an output signal from said seconds counter as an input signal, said reversible counters being responsive to said first correction signal for counting in an upward direction and to said second correction signal for counting in a downward direction.

13. A correction system according to claim 12, and further comprising a divider coupled to receive an output signal from said standard frequency signal source, and moreover comprising waveshaping circuit means coupled to receive an output signal from said divider and motor drive circuit means responsive to an output signal from said waveshaping circuit means for generating drive signals to drive said stepping motor.

14. A correction system according to claim 11, wherein said external operating member is movable to each of at least three different stable positions along the axis of rotation thereof, and whereby said timepiece operates in a normal time display mode when said external operating member is in a first one of said axial positions, and whereby said correction signal generating switch means is coupled to said external operating member and said correction signals are applied to said timekeeping circuit in a second one of said axial positions, and further whereby said external operating member is coupled to said wheel train of said analog display when said external operating member is in a third one of said axial positions.

15. A correction system according to claim 14, in which said timepiece is operable in a plurality of function modes including a function mode in which current time is displayed by said digital display, and further comprising function mode selection switch means for generating an output signal, and mode selection circuit means responsive to said output signal from said function mode selection switch for changing over the data displayed by said digital display from data corresponding to one of said function modes to data corresponding to another of said function modes, and further wherein data corresponding to a selected function mode is alterable by establishing said digital display correction mode and rotation of said external operating member.

16. A correction system according to claim 15, in which said function mode selection switch means is responsive to depression of said external operating member in a direction which is inward with respect to the body of said timepiece, for producing said output signal.

17. A correction system according to claim 15, further comprising switch means coupled to said external operating member, and responsive to said external operating member being set to said third stable position for producing an output signal, and wherein said mode selection circuit means is responsive to said output signal for establishing said function mode in which current time is displayed by said digital display.

18. A correction system according to claim 11, wherein said correction switch means comprises at least one movable contact forming part of said rotor and a plurality of fixed contacts, and wherein said rotor is coupled to a source of a predetermined logic level potential whereby said fixed contacts are sequentially and momentarily connected to said logic level potential as said rotor is rotated, and further comprising correction signal discrimination circuit means coupled to said fixed contacts and responsive to signals appearing on said fixed contacts in a sequence resulting from rotation of said rotor in said first direction for producing said first correction signal and further responsive to signals appearing on said fixed contacts in a sequence resulting from rotation of said rotor in said second direction for producing said second correction signal.

19. A correction system according to claim 18, wherein said correction switch means includes at least three fixed contacts, and wherein said correction signal discrimination circuit means comprises:

a first set/reset flip-flop coupled to be set by signals appearing on a first one of said fixed contacts and reset by signals appearing on a third one of said fixed contacts;

a second set/reset flip-flop coupled to be set by signals appearing on a second one of said fixed contacts and reset by signals appearing on a second one of said fixed contacts;

a third set/reset flip-flop coupled to be set by signals appearing on said third fixed contact and reset by signals appearing on said second one of said fixed contacts;

a first logic AND gate coupled to receive a non-inverting output from said first flip-flop and to receive signals from said second fixed contact;

a second logic AND gate coupled to receive an inverting output from said first flip-flop and to receive signals from said second fixed contact;

a third logic AND gate coupled to receive a non-inverting output from said second flip-flop and to receive signals from said third fixed contact;

a fourth logic AND gate coupled to receive an inverting output from said second flip-flop and to receive signals from said third fixed contact;

a fifth logic AND gate coupled to receive a non-inverting output from said third flip-flop and to receive signals from said first fixed contact;

a sixth logic AND gate coupled to receive an inverting output from said third flip-flop and to receive signals from said first fixed contact;

a first logic OR gate coupled to receive output signals from said second, fourth and sixth logic AND gates, for thereby producing said first correction signal comprising a train of pulses having a frequency determined by the rate of rotation of said external operating member; and a second logic OR gate coupled to receive output signals from said first, third and fifth logic AND gates, for thereby producing said second correction signal, comprising a train of pulses having a frequency determined by the rate of rotation of said external operating member.

20. A correction system according to claim 11, in which said correction switch means is actuated to produce said first correction signal for incrementing data contents of said digital display when said external operating member is rotated in said first direction of rotation, and in which said correction switch means is actuated to produce said second correction signal for decrementing data contents of said digital display when said external operating member is rotated in said second direction of rotation.

21. A correction system for an electronic timepiece having an analog display including time indicating hands for indicating current time data and a digital display for indicating at least current time data, a stepping motor coupled through a wheel train to said time indicating hands to drive said analog display, and timekeeping circuit means and drive circuit means for generating signals to drive said stepping motor and to drive said digital display, comprising:

a rotatable external operating member movable in an axial direction to selectively establish an analog correction mode of operation and a digital correction mode of operation in dependence on a selected axial position of said external operating member;

a hands adjusting mechanism for correcting the current time data displayed by said time indicating hands;

means for coupling said external operating member mechanically to said hands adjusting mechanism in response to the establishment of said analog correction mode of operation in which rotation of said external operating member in a first direction acts to advance a time displayed by said time indicating hands and in which rotation of said external operating member in a second direction opposite to said first direction acts to retard said time displayed by said time indicating hands;

correction switch means including a movable contact and responsive to movement of said movable contact in a first manner for producing a first correction signal and responsive to movement of said movable contact in a second manner different from said first manner for producing a second correction signal; and means for coupling said correction switch means to be moved by said external operating member and for selectively applying said first and second correction signals to said timekeeping circuit means, in response to the establishment of said digital correction mode of operation in which said timekeeping circuit means is responsive to said first correction signal for incrementing time data produced thereby and responsive to said second correction signal for decrementing time data produced thereby, whereby time data displayed by said digital display is advanced in response to said first correction signal and is retarded in response to said second correction signal, when said timepiece is in said digital display correction mode of operation;

wherein said correction switch means comprises at least one movable contact forming part of said rotor and a plurality of fixed contacts, and wherein said rotor is coupled to a source of a predetermined logic level potential whereby said fixed contacts are sequentially and momentarily connected to said logic level potential as said rotor is rotated, and further comprising correction signal discrimination circuit means coupled to said fixed contacts and responsive to signals appearing on said fixed contacts in a sequence resulting from rotation of said rotor in said first direction for producing said first correction signal and further responsive to signals appearing on said fixed contacts in a sequence resulting from rotation of said rotor in said second direction for producing said second correction signal; and wherein said correction switch means includes at least three fixed contacts, and wherein said correction signal discrimination circuit means comprises:

a first set/reset flip/flop coupled to be set by signals appearing on a first one of said fixed contacts and reset by signals appearing on a third one of said fixed contacts;

a second set/reset flip-flop coupled to be set by signals appearing on a second one of said fixed contacts and reset by signals appearing on a second one of said fixed contacts;

a third set/reset flip-flop coupled to be set by signals appearing on said third fixed contact and reset by signals appearing on said second one of said fixed contacts;

a first logic AND gate coupled to receive a non-inverting output from said first flip-flop and to receive signals from said second fixed contact;

a second logic AND gate coupled to receive an inverting output from said first flip-flop and to receive signals from said second fixed contact;

a third logic AND gate coupled to receive a non-inverting output from said second flip-flop and to receive signals from said third fixed contact;

a fourth logic AND gate coupled to receive an inverting output from said second flip-flop and to receive signals from said third fixed contact;

a fifth logic AND gate coupled to receive a non-inverting output from said third flip-flop and to receive signals from said first fixed contact;

a sixth logic AND gate coupled to receive an inverting output from said third flip-flop and to receive signals from said first fixed contact;

a first logic OR gate coupled to receive output signals from said second, fourth and sixth logic AND gates, for thereby producing said first correction signal comprising a train of pulses having a frequency determined by the rate of rotation of said external operating member; and a second logic OR gate coupled to receive output signals from said first, third and fifth logic AND gates, for thereby producing said second correction signal, comprising a train of pulses having a frequency determined by the rate of rotation of said external operating member.

22. A correction system according to claim 21, in which said external operating member comprises a timepiece crown attached to a time setting stem; and in which said correction switch means includes speed increasing gear train for transmitting the rotational speed of said stem to said rotor while increasing said rotational speed.

23. A correction system for an electronic timepiece having an analog display including time indicating hands for indicating current time data and a digital display for indicating at least current time data, a stepping motor coupled through a wheel train to said time indicating hands to drive said analog display, and timekeeping circuit means and drive circuit means for generating signals to drive said stepping motor and to drive said digital display, comprising:

a rotatable external operating member movable in an axial direction to selectively establish an analog correction mode of operation and an digital correction mode of operation in dependence on a selected axial position of said external operating member;

a hands adjusting mechanism for correcting the current time data displayed by said time indicating hands;

means for coupling said external operating member mechanically to said hands adjusting mechanism in response to the establishment of said analog correction mode of operation in which rotation of said external operating member in a first direction acts to advance a time displayed by said time indicating hands and in which rotation of said external operating member in a second direction opposite to said first direction acts to retard said time displayed by said time indicating hands;

correction switch means including a movable contact and responsive to movement of said movable contact in a first manner for producing a first correction signal and responsive to movement of said movable contact in a second manner different from said first manner for producing a second correction signal; and means for coupling said correction switch means to be moved by said external operating member and for selectively applying said first and second correction signals to said timekeeping circuit means, in response to the establishment of said digital correction mode of operation in which said timekeeping circuit means is responsive to said first correction signal for incrementing time data produced thereby and responsive to said second correction signal for decrementing time data produced thereby, whereby time data displayed by said digital display is advanced in response to said first correction signal and is retarded in response to said second correction signal, when said timepiece is in said digital display correction mode of operation;

in which said external operating member comprises a timepiece crown attached to a time setting stem; and further comprising a clutch wheel slidably mounted on said time setting stem and adapted to be rotated in unison therewith, and having first engaging means mounted at one end thereon concentric with the axis of rotation of said time setting stem and second engaging means mounted at the axially opposite end thereof, and moreover comprising setting means mechanically linked to said clutch wheel and said time setting stem for controlling the position of said clutch wheel in accordance with movement of said time setting stem in the axial direction, wherein said first engaging means of said clutch wheel engages with said correction switch means when said crown is moved to a first axial position whereby said correction switch means can be actuated to produce said first or said second correction signal by rotation of said crown, and wherein said second engaging means of said clutch wheel engages with said wheel train of said analog display when said crown is moved to a second axial position, whereby said time indicating hands can be advanced or retarded by rotation of said crown.

24. A correction system according to claim 23, in which said external operating member comprises a timepiece crown attached to a time setting stem; and in which said correction switch means includes speed increasing gear train for transmitting the rotational speed of said stem to said rotor while increasing said rotational speed.

* * * * *